US009457289B2

(12) United States Patent
Zimmerman et al.

(10) Patent No.: US 9,457,289 B2
(45) **Date of Patent: *Oct. 4, 2016**

(54) SMOKE EMITTING TOY

(71) Applicant: Buzz Bee Toys (H.K.) Co., Limited, Kowloon (HK)

(72) Inventors: Jeffrey C. Zimmerman, King of Prussia, PA (US); Chor-Ming Ma, Kowloon (HK)

(73) Assignee: Buzz Bee Toys (H.K.) Co. Limited, Kowloon (HK)

( * ) Notice: Subject to any disclaimer, the term of this patent is extended or adjusted under 35 U.S.C. 154(b) by 130 days.

This patent is subject to a terminal disclaimer.

(21) Appl. No.: 14/018,534

(22) Filed: Sep. 5, 2013

(65) Prior Publication Data

US 2015/0065005 A1 Mar. 5, 2015

(30) Foreign Application Priority Data

Sep. 4, 2013 (HK) ..... 13110306

(51) Int. Cl.

| | |
|---|---|
| ***A63H 33/28*** | (2006.01) |
| ***A63H 5/04*** | (2006.01) |
| ***F41B 11/724*** | (2013.01) |
| ***F41B 11/89*** | (2013.01) |
| ***F41B 11/684*** | (2013.01) |

(52) U.S. Cl.

CPC ..... *A63H 33/28* (2013.01); *A63H 5/04* (2013.01); *F41B 11/684* (2013.01); *F41B 11/724* (2013.01); *F41B 11/89* (2013.01)

(58) Field of Classification Search

CPC ..... F41B 11/89

USPC ..... 446/23, 24, 473; 431/320; 42/54–55, 42/58; 124/65, 55, 73–75; 251/325

See application file for complete search history.

(56) References Cited

U.S. PATENT DOCUMENTS

| | | | | |
|---|---|---|---|---|
| 1,262,004 A * | 4/1918 | Beachy | ..... | 124/65 |
| 1,332,490 A * | 3/1920 | Emerson | ..... | 124/29 |
| 2,324,359 A * | 7/1943 | Callan | ..... | 446/24 |

(Continued)

FOREIGN PATENT DOCUMENTS

JP 3034518 B1 * 4/2000 ..... F41B 11/00

OTHER PUBLICATIONS

Bibliographic data for JP 3034518 B1, including Abstract in English, Espacenet.*

(Continued)

*Primary Examiner* — Melba Bumgarner
*Assistant Examiner* — Laura L Davison

(57) ABSTRACT

A toy gun capable of firing a projectile and simultaneously or near simultaneously, emitting smoke from the muzzle of a barrel of the gun after the projectile has been discharged from the muzzle. The toy gun has first and second rechargeable air pumps, with the first air pump automatically discharging stored air into a breech part of the barrel in order to propel a loaded projectile from the barrel, and the second air pump expelling stored air through a flow restriction device which serves as a pressure switch for actuating a smoke generator located adjacent to the muzzle. The second air pump also provides a low air flow rate through the smoke generator to expel smoke therefrom. The second air pump expels stored air much more slowly than the first air pump. The first and second air pumps are simultaneously triggered to release stored air by a user.

11 Claims, 12 Drawing Sheets

(56) References Cited

U.S. PATENT DOCUMENTS

| | | | | |
|---|---|---|---|---|
| 2,665,676 | A * | 1/1954 | Mobley, Jr. | 124/64 |
| 4,212,285 | A * | 7/1980 | Cagan et al. | 124/67 |
| 4,728,286 | A * | 3/1988 | Olsen | 431/320 |
| 4,741,717 | A * | 5/1988 | Wolf | 446/24 |
| 5,205,771 | A | 4/1993 | Sims | |
| 5,512,001 | A | 4/1996 | Kent et al. | |
| 6,000,386 | A * | 12/1999 | Johnson et al. | 124/69 |
| 6,421,502 | B1 | 7/2002 | Aronie et al. | |
| 7,789,729 | B1 | 9/2010 | Ivanic et al. | |
| 2014/0065577 | A1 * | 3/2014 | Quinlan et al. | 434/18 |

OTHER PUBLICATIONS

Machine translation of JP 3034518 B1, Espacenet.*

* cited by examiner

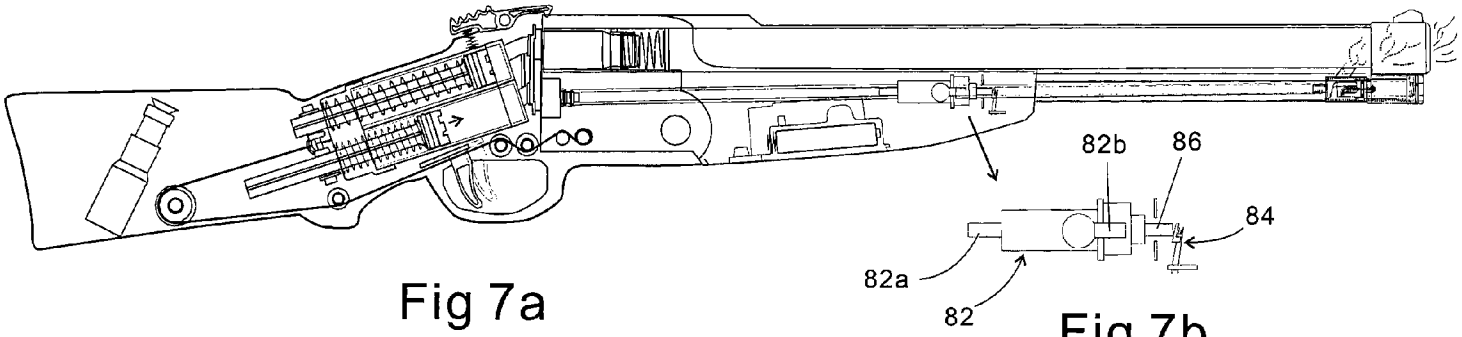
Fig 7b
Fig 7a
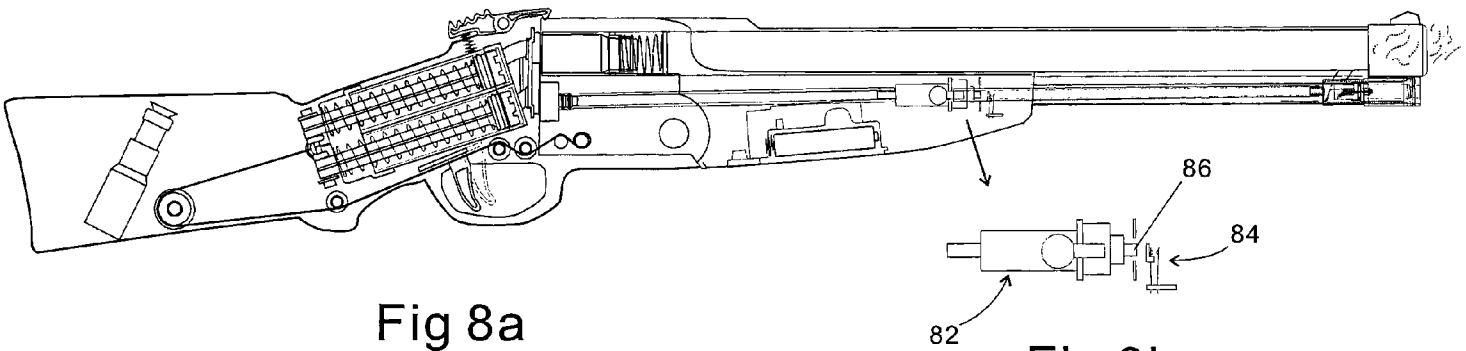
Fig 8b
Fig 8a

SMOKE EMITTING TOY

FIELD OF THE INVENTION

The invention relates to a smoke emitting toy and particularly, but not exclusively to a toy gun in the form of a breech loading rifle which is capable of firing a projectile as well as emitting smoke.

BACKGROUND OF THE INVENTION

Smoke emitting toys are known. For example, U.S. Pat. No. 4,741,717 discloses a doll. The doll has a smoke generator and a manually actuated air pump. To emit smoke from the doll, a user manually depresses a switch to power a heating element to heat an oil containing wick to produce smoke and manually depresses a piston of the pump to cause air to flow through the smoke generating chamber to convey smoke to a smoke outlet. This disclosure requires the user to continuously manually operate the switch to produce smoke whilst manually operating the pump to expel smoke.

U.S. Pat. No. 5,205,771 discloses a toy airplane for producing smoke filled bubbles. A manually actuated air bellows and a smoke generator mechanism are connected to a tube having an aperture. A soapy liquid film is provided over the aperture. In use, a user manually actuates both the air bellows and a switch of the smoke generating mechanism continuously to cause smoke laden air to exit the aperture through the soapy film thereby producing smoke filled bubbles.

U.S. Pat. No. 5,512,001 discloses a toy vehicle having a smoke generating mechanism and an air bellows. The air bellows is linked to a spoiler part of the vehicle by a mechanical linkage. Repeated manual depression of the spoiler causes the air bellows to expel air through the smoke generating mechanism to thereby emit smoke from an exhaust pipe of the toy vehicle.

U.S. Pat. No. 6,421,502 discloses a toy gun with a smoke generating chamber. A diaphragm extends across a rear part of the chamber. A reciprocating actuator moveable in response to continuous actuation of a trigger causes movement of the diaphragm thereby causing smoke to be emitted as a series of smoke rings from the toy gun.

U.S. Pat. No. 7,789,729 discloses a toy gun in the form of a breech loadable toy shotgun. Shells can be loaded into over and under barrels at the breech. The shells are automatically ejected from the breech when the gun is opened. A smoke generator is positioned near the breech to emit smoke in the breech chamber when the gun is opened. The toy gun does not discharge any projectiles.

It is realized by the inventors that none of the prior art toys provides the ability to fire a toy projectile whilst emitting smoke in response to the firing of a projectile. It would be desirable to provide a toy having the aforementioned capabilities.

OBJECTS OF THE INVENTION

An object of the invention is to mitigate or obviate to some degree one or more problems associated with prior art smoke emitting toys.

The above object is met by the combination of features of the main claims; the sub-claims disclose further advantageous embodiments of the invention.

Another object of the invention is to provide an improved smoke emitting toy.

Another object of the invention is to provide a toy gun having the ability to fire a toy projectile whilst emitting smoke following firing of the projectile.

Another object of the invention is to provide a toy gun having the ability to automatically fire a toy projectile whilst emitting smoke following firing of the projectile One skilled in the art will derive from the following description other objects of the invention. Therefore, the foregoing statements of object are not exhaustive and serve merely to illustrate some of the many objects of the present invention.

SUMMARY OF THE INVENTION

In one main aspect, the invention provides a toy gun comprising: a barrel; a mechanism for discharging a projectile from a muzzle of the barrel; and a smoke generator arranged to emit smoke when the discharging mechanism has been actuated to discharge a projectile from the muzzle. Preferably, the smoke is emitted automatically. In one embodiment, the smoke generator may be positioned closely adjacent to a front portion of the barrel comprising the muzzle, although it may be positioned at any point on the gun in similar manner to some of the prior art arrangements. By positioning the smoke generator at or near the tip of the barrel renders it easy to provide a supply of smoke to be emitted from the tip or near the tip, i.e. muzzle of the barrel or to be emitted nearly adjacent to the tip of the barrel after the projectile has left the barrel.

Preferably, the smoke generator has an outlet in gaseous communication with a portion of the barrel such that smoke emitted by the smoke generator passes into the portion of the barrel and emanates from the muzzle of the barrel. Preferably also, the smoke generator outlet is in gaseous communication with a front or tip portion of the barrel comprising the muzzle.

Preferably also, the smoke generator is arranged to emit smoke immediately, or a short period of time after, the discharging mechanism has been actuated to discharge a projectile from the muzzle. The short period of time is determined as a period of time needed for the projectile to be discharged from the barrel such that smoke is emitted from the tip of the barrel not before the projectile leaves the barrel muzzle or tip. The projectile is preferably a dart.

Preferably, the smoke generator is arranged to be on for a predetermined period of time. A heating element of the smoke generator is battery powered. Thus, intermittent switching on of the smoke generator, i.e. its heating element, saves battery life. The timing of turning on of the smoke generator is dependent on the physical arrangement of the means by which a switch for the heating element is actuated. In the present invention, the means for actuating the switch can be designed to actuate the switch immediately the projectile discharge mechanism is actuated or at a period of time later. Preferably also, the mechanism for discharging comprises a first gas storage device for discharging gas into a rear portion of the barrel to cause a projectile loaded in the barrel to be discharged at speed from the muzzle of the barrel.

The smoke generator has a housing with an inlet and an outlet. The toy gun may further comprise: a second gas storage device having an outlet connected to the inlet of the housing; and mechanism for automatically expelling some gas from the second gas storage device in response to a trigger event whereby at least some of said released gas is conveyed to the inlet of the housing, said released gas passing into the housing via the inlet and exiting the housing via the outlet, said gas exiting the housing carrying with it some smoke generated by the smoke generator. Preferably, the first and/or second gas storage device stores air and comprises a rechargeable gas storage device. The or each storage device may be manually rechargeable and may comprise a pump. The or each pump may comprise a cylinder housing a piston, the piston being adapted for movement within the cylinder to expel air from the cylinder through a pump outlet. The or each pump may be rechargeable with air by drawing the piston away from the pump outlet causing air to be drawn into the cylinder via a pump inlet.

Preferably, once the piston is withdrawn away from the outlet to a pumped charged position, a latch holds the piston in its pump charged position against a biasing force of a biasing means whereupon, in response to a trigger event, the latch releases the piston, which, under a force exerted by the biasing means, moves towards the pump outlet thereby expelling air stored in the cylinder through the pump outlet. The or each biasing means may comprise a compression spring, although any suitable biasing means may be utilized.

Preferably, the biasing means of the first gas storage device is adapted to exert a substantially larger biasing force than the biasing means of the second gas storage device. The biasing means of the first gas storage device is adapted to expel stored air quickly by way of providing a propelling force to a projectile loaded in the barrel of the gun. In contrast, the biasing means of the second gas storage device is intended to expel stored air much more slowly.

The pump inlet may be co-incident with the pump outlet thereby simplifying the pump cylinder design.

The toy gun has a trigger which when depressed causes the first and second air pumps to expel stored air. Thus, firing a projectile from the barrel and causing emission of smoke from the tip of the barrel are automatically initiated in response to a user action, namely depressing or pulling of the trigger. Depressing or pulling the trigger results in release of the or each pump piston from its latch. Preferably, the same trigger event initiates automatic release of some gas from the or each gas storage device and automatically switches on the smoke generator to cause the smoke generator to start generating smoke and preferably does so simultaneously.

Preferably also, the toy gun further comprises a gas flow restriction device in a gas passageway connecting the outlet of the second gas storage device to the inlet of the smoke generator housing, whereby the gas flow restriction device controls the flow rate of released gas into the housing of the smoke generator. The gas flow restriction device may have a moveable member arranged such that gas pressure exerted on said moveable member by released gas causes said member to move from a first position to a second position to thereby actuate a switch for switching on the smoke generator to cause the smoke generator to start generating smoke. The gas flow restriction device may be arranged to slow the flow rate of released gas such that the moveable member remains in its second position actuating the switch for a predetermined period of time after which the moveable member is returned to its first position. Preferably, the gas flow restriction device is adapted to slow the flow rate of released gas to the housing of the smoke generator by forcing released gas through a leakage path defined by at least one surface of the moveable member.

The smoke generator housing may be adapted to receive a smoke oil container whereby a wick or cord of the smoke generator is positioned to enter the container to draw smoke oil therefrom by a wicking action. The smoke generator housing may have a member for piercing a seal of the smoke oil container as said smoke oil container is being received in the housing.

The toy gun may be arranged such that the first and/or second gas storage devices are recharged by the action of opening the breech of the rifle.

In another main aspect, the invention provides a smoke emitting system for a toy, comprising: a smoke generator having a housing, the housing having an inlet and an outlet; a gas storage device having an outlet connected to the inlet of the housing; mechanism for automatically expelling some gas from the gas storage device in response to a trigger event whereby at least some of said released gas is conveyed to the inlet of the housing, said released gas passing into the housing via the inlet and exiting the housing via the outlet, said gas exiting the housing carrying with it some smoke generated by the smoke generator.

In another main aspect, the invention provides a smoke generator for a toy, comprising: a housing; a wick; and a heating element arranged close to a portion of the wick within the housing such that when the heating element is actuated and becomes sufficiently hot it causes oil in the wick to smoke; wherein the housing is adapted to receive a smoke oil container and another portion of the wick is positioned relative to the housing to enter the container to draw smoke oil therefrom by a wicking action and the housing has a member for piercing a seal of the smoke oil container as said smoke oil container is being received at the housing. The portion of the wick positioned to enter the smoke oil container when it is being received at the housing may be enclosed by the piercing member. The heating element may be surrounded by a ceramic housing, the ceramic housing being contained within the smoke generator housing.

The smoke generator housing has an inlet for admitting air and an outlet for emitting air laden with smoke. Preferably, the smoke generator housing comprises a first main housing part and a smoke delivery tube part, the main housing part being adapted to fit within the smoke delivery tube part and the smoke delivery tube part having a smoke delivery pipe extending outwardly therefrom such that, when the main housing part is received in the smoke delivery tube part, the outlet of the main housing part is in gaseous communication with the smoke delivery pipe to convey air laden with smoke away from the smoke generator.

In another main aspect, the invention provides a gas flow restriction device for a toy, comprising: a housing having an inlet and an outlet, said housing defining a gas flow passageway between said inlet and said outlet; and a moveable member arranged in the gas flow passageway such that pressure of gas entering the inlet exerted on said moveable member causes said member to move from a first position to a second position against the action of a biasing means which normally holds the moveable member in its first position; wherein the moveable member is adapted to slow the flow rate of gas through the gas flow passageway by forcing gas to pass through a leakage path defined by at least one surface of the moveable member. The moveable member may have a plunger member which extends through a wall of the housing and said plunger is adapted to engage a switch to actuate it when said moveable member is moved to its second position.

In one embodiment, the housing comprises a cylinder and the moveable member comprises a piston, the piston being dimensioned to have a sliding fit within the cylinder but such that air under pressure entering the inlet of the housing can leak over the external surface of the piston to reach the outlet, the external surface of the piston and the internal surface of the housing between them defining a leakage path part of the gas flow passageway.

In another embodiment, the housing contains an open-ended cylinder affixed around the inlet and the moveable member comprises a cylinder open at one end and moveably mounted on the fixed cylinder, such that air under pressure entering the inlet of the housing can leak over a part of the internal surface of the moveable cylinder which overlaps a part of the external surface of the fixed cylinder, the part of the internal surface of the moveable cylinder and the part of the external surface of the fixed cylinder between them defining a leakage path part of the gas flow passageway.

The gas flow restriction device comprises a pressure switch system for the toy gun.

In another main aspect, the invention provides a toy having any one or any combination of a smoke emitting system according to the invention, a smoke generator according to the invention, or a gas flow restriction device according to the invention.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which:

FIG. 7*a* is a side view of the toy gun of FIG. 1 in a partially fired condition where the projectile has been discharged from the barrel and smoke is beginning to be emitted from the tip of the barrel;

FIG. 7*b* is an enlarged view of the pressure switch system in an actuated condition;

FIG. 8*a* is a side view of the toy gun of FIG. 1 in a fully fired condition where the projectile has been discharged from the barrel and smoke is ceasing to be emitted from the tip of the barrel;

FIG. 8*b* is an enlarged view of the pressure switch system in a not actuated condition;

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Whilst the description of a preferred embodiment is based on a breech loading toy rifle, it will be understood that many of the aspects of the present invention are applicable to toy guns of any type which are arranged to emit smoke and indeed to toys of any type which are arranged to emit smoke.

Figure 1:
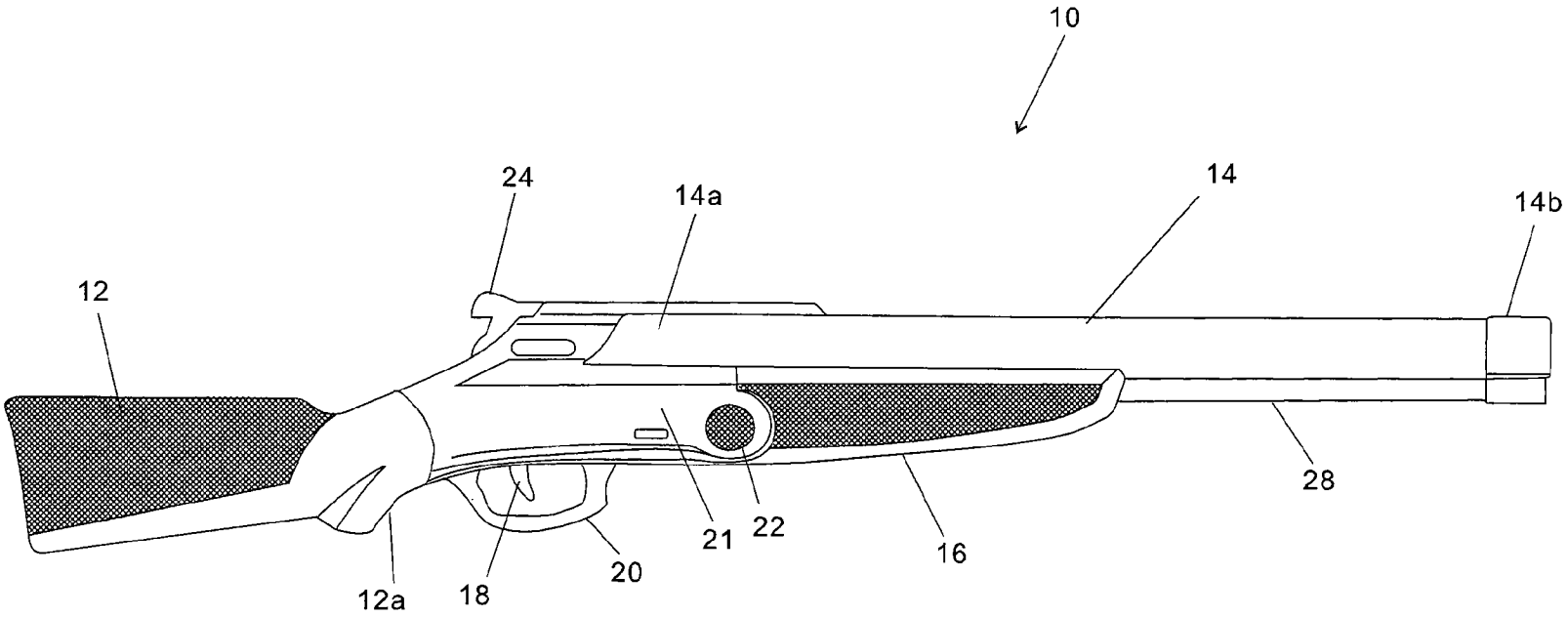
FIG. 1 is a side view of a toy gun according to one embodiment of the invention.

Referring to FIG. 1, there is shown a breech loading toy rifle 10 having a butt or stock 12 providing a first hand grip 12*a*, a barrel 14, a second hand grip 16 under the barrel, a trigger 18 with a trigger guard 20 provided on a breech block 21 under a breech end 14*a* of the barrel 14, a hinge 22 at an end of the breech block 21 for enabling the rifle 10 to be opened at the breech, a false hammer 24 which, as can be seen in other figures, comprises a spring loaded latch 26 for holding the rifle in a closed position. A tubular member 28 extends under the barrel 14 from a tip 14*b* of the barrel 14 to at least the second hand grip 16.

The term 'breech' is used herein to refer to that part of the rifle comprising a rear end portion, i.e. breech end 14*a*, of the barrel 14 and the breech block 21.

Referring to FIGS. 2 to 8 which reveal the internal components of the rifle 10 and which show the rifle in various states of operation as will be explained hereinbelow, it can be seen that the rifle 10 has a smoke generator 30 arranged within the tubular member 28 and positioned at or closely adjacent to the tip 14*b* of the barrel 14, although the smoke generator in some embodiments could be placed elsewhere on the toy gun and arranged to emit smoke from other parts of the toy gun other than the barrel. A battery compartment 32 is provided in the second hand grip 16 to receive batteries 34 for powering the smoke generator 30, i.e. to provide electrical power to a heating element of the smoke generator 30. FIG. 2*a* shows the toy rifle 10 in a not yet loaded state. FIG. 2*b* shows an enlarged side view of the tip portion 14*b* of the barrel 14 where a smoke oil refill container 36 is removed from the smoke generator 30, whereas FIG. 2*c* is an enlarged side view of the tip portion 14*b* in which the smoke oil refill container 36 is received in the smoke generator 30. Similarly, FIG. 2*d* is an enlarged end view of the tip portion 14*b* showing the smoke oil container 36 inserted into a tip end of the tubular member 28. The smoke refill oil container 36 may be refilled when empty by a user of the rifle, but sealed filled smoke oil containers 36 may be made available for purchase to save users from the need to buy a supply of smoke oil for refill purposes.

The smoke generator 30 has an outlet 30*a* which extends from a top of the smoke generator 30 into the tip portion 14*b* of the barrel 14 such that a smoke chamber of the smoke generator 30 is in gaseous communication with the tip portion, i.e. muzzle, 14*b* of the barrel 14. In some embodiments, the smoke generator may be positioned such that its outlet is in gaseous communication with portions of the barrel other than the tip or muzzle. It will be appreciated that the passage of a projectile along the barrel may in some circumstances create a sufficient back pressure to draw smoke from the barrel where said smoke is communicated to a portion of barrel nearer to a middle or the breech part of the barrel. The smoke generator 30 also has an inlet 30*b* for admitting air or gas. Air or gas admitted through the inlet 30*b* to the smoke chamber of the smoke generator 30 may exit the smoke generator 30 by its outlet 30*a* and, in doing so, convey some smoke into the tip portion 14*b* of the barrel 14 where the smoke will eventually emanate from the barrel muzzle.

Provided within an end part of the butt 12 coincident with the first hand grip 12*a* are first and second air storage devices 38, 40 in the form of first and second piston pumps. Each piston pump 38, 40 comprises a cylinder 42, 44 housing a spring loaded piston 46, 48. In an uncharged state as seen in FIG. 2, the pistons 46, 48 are urged by their respective compression springs 50, 52 towards or against an end of the cylinder having an aperture 54, 56 comprising both a gas/air inlet and outlet for the cylinder 42, 44. In the preferred embodiment, the cylinders 42, 44 are charged with atmospheric air. Whilst the biasing means for each of the first and second piston pumps 38, 40 are shown as compression springs 50, 52, it will be understood that any suitable biasing means may be used. Furthermore, whilst the first and second air storage devices are described as piston pumps 38, 40, it will be appreciated that any means that can be triggered to automatically discharge some gas or air under pressure will be sufficient to act as the first and second air storage devices. It will also be understood that the first and second air storage devices may comprise different types of devices from each other for automatically discharging a charge of air or gas under pressure.

Figure 2A:
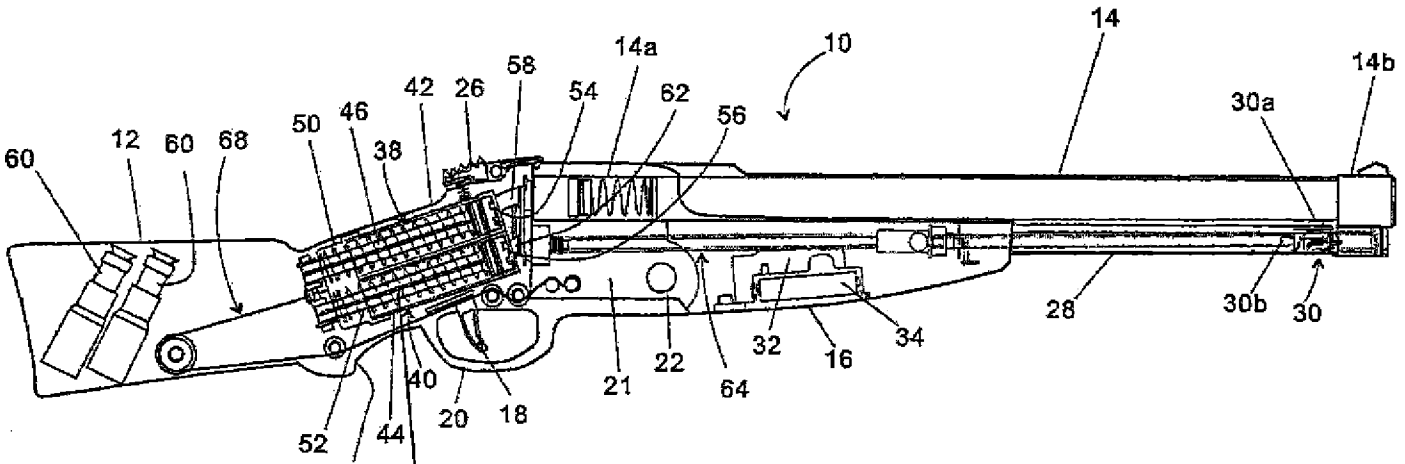
FIG. 2*a* is a side view of the toy gun of FIG. 1, but showing the internal structure of the gun.
Figure 2C:
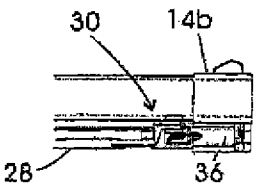
FIG. 2*c* is an enlarged side view of a tip of the toy gun barrel showing a smoke oil container received in the gun.
Figure 2B:
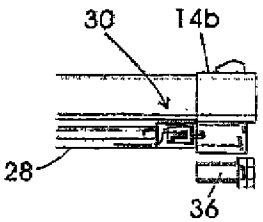
FIG. 2*b* is an enlarged side view of a tip of the toy gun barrel showing a smoke oil container removed from the gun.
Figure 2D:
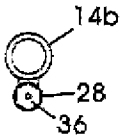
FIG. 2*d* is an enlarged end view of a tip of the toy gun barrel showing a smoke oil container received in the gun.

The aperture 54 of the first piston pump 38 is connected by an air passageway 58 to a breech end 14*a* of the barrel 14 such that, when the first piston pump 38 is triggered to discharge its store of air, air under pressure is supplied to the breech end 14*a* of the barrel 14 to thereby propel a projectile 60 loaded into the barrel 14 along the barrel 14 to exit the barrel 14 at speed. In FIG. 2*a*, two projectiles ready for loading into the barrel 14 are shown attached to the stock 12 of the rifle 10.

The aperture 56 of the second piston pump 40 is connected via an air passageway 62 to an end of an air passageway member 64 which connects the outlet 56 of the second piston pump 40 to the inlet 30*b* of the smoke generator 30, although the air connection is not a direct one as will be explained below. Each of the air passageways 58, 62 exits at a breech plate 66 (FIG. 3) which forms a gas tight seal against an end of the breech block 21 when the toy rifle 10 is closed.

A pulley system 68 is provided which extends between the breech block 21 and ends of the pistons 46, 48 such that, when the toy rifle is opened at the breech, the pulley system 68 withdraws the pistons 46, 48 within their cylinders 42, 44 against the urging force of their respective compression springs 50, 52. When the breech of the toy rifle is fully open and the pistons 46, 48 have been withdrawn to a charged position, respective latch 70, 72 associated with the first and second piston pumps 38, 40 latch the withdrawn pistons 46, 48 in their charged positions. It will be understood that, as the pistons 46, 48 are withdrawn in their cylinders 42, 44, they draw air (or gas) via their respective apertures 54, 56 into the cylinders 42, 44.

As already explained, FIG. 2*a* shows the toy rifle 10 in a closed and unloaded state where the pistons 46, 48 of the piston pumps 38, 40 are resting in their discharged positions within their cylinders 42, 44.

Figure 3:
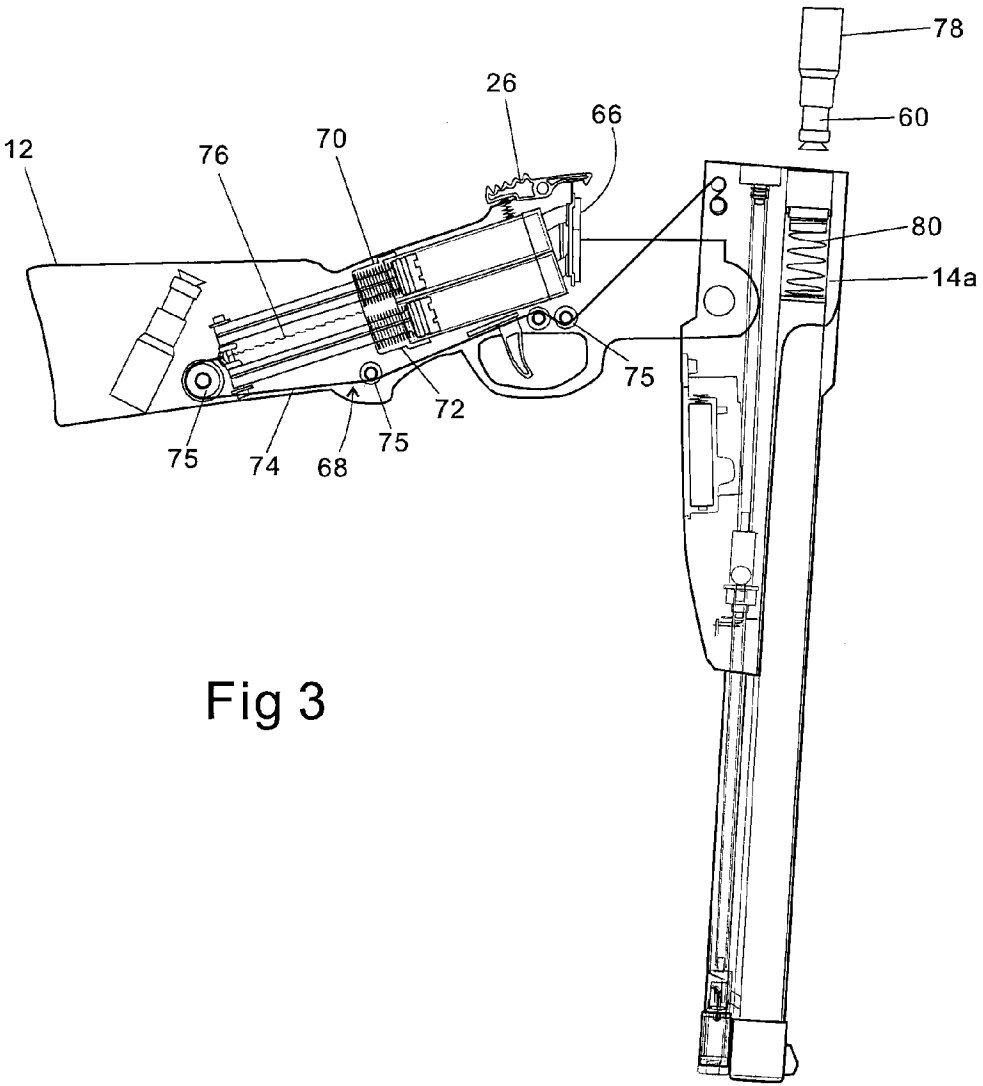
FIG. 3 is a side view of the toy gun of FIG. 1 with the gun breech in an open position ready to be loaded with a projectile.

In contrast to FIG. 2*a*, FIG. 3 shows the toy rifle 10 in a fully opened, yet unloaded state. It can be seen that the pulley system 68 has been drawn forward by the open breech block 21 such that the pistons 46, 48 now occupy their charged, latched positions. The rifle 10 is opened by a user depressing the false hammer spring loaded latch 26 which releases the barrel 14 to hingedly swing away from the gun stock 12. The pulley system 68 comprises a cord 74 extending between the end of the breech block 21 and the ends of the pistons 46, 48. The cord extends around a series of pulley wheels 75. The pulley system 68 includes a return spring 76. The breech end 14*a* of the barrel is adapted to receive a projectile 60 such as a dart housed in a cartridge or shell 78 such that, when the projectile 60 is discharged from the rifle barrel 14, the cartridge or shell 78 remains. The breech end 14*a* of the barrel 14 has a spring loaded cartridge receiving means 80 which locks a loaded cartridge 78 into the breech end 14*a* when the cartridge 78 is manually pushed into the breech end 14*a* of the barrel.

Figure 4:
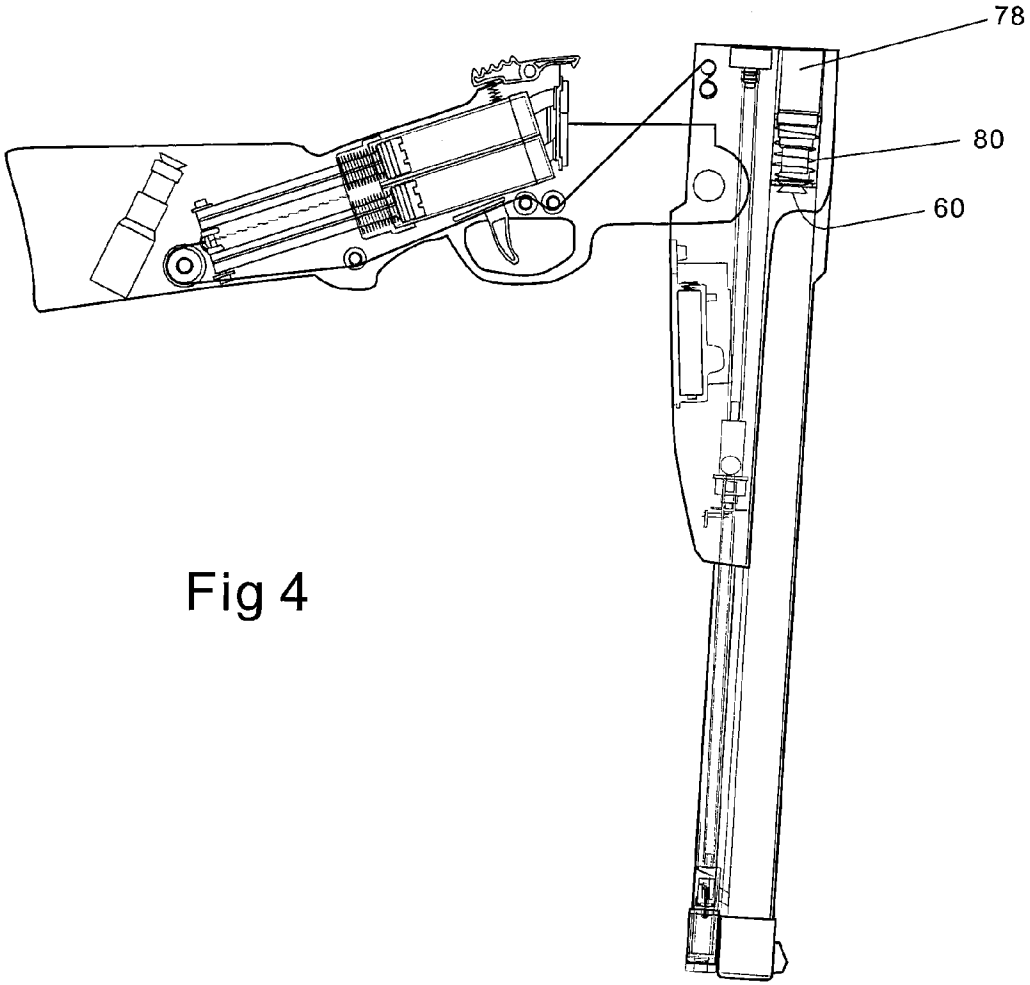
FIG. 4 is a side view of the toy gun of FIG. 1 with the gun breech in an open position and a projectile housed in a cartridge loaded into the barrel breech with a cartridge shell ejection spring in a locked to eject position.

Referring to FIG. 4 which shows the toy rifle 10 in a loaded yet opened state, it can be seen that a cartridge 78 carrying a dart 60 has been loaded into the breech end 14*a* of the barrel 14 and locked in place under spring pressure by the cartridge receiving means 80.

Figure 5:
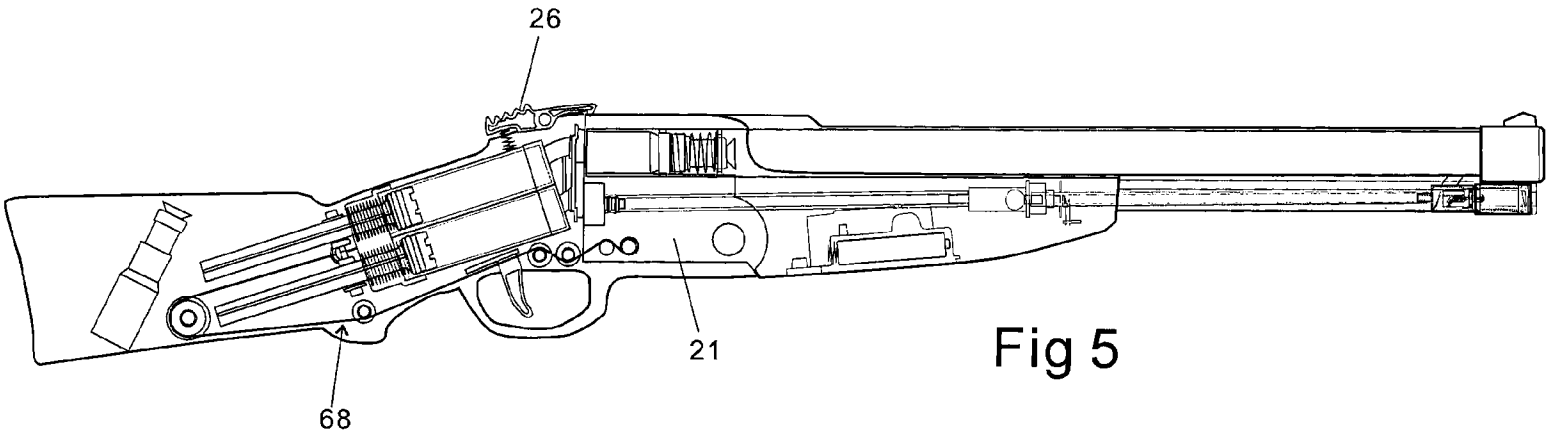
FIG. 5 is a side view of the toy gun of FIG. 1 with the breech closed and in a ready to fire condition.

FIG. 5 shows the rifle 10 in a loaded and ready to fire state. In contrast to FIGS. 3 and 4, the rifle 10 has been returned to a closed state where the latch means 26 has reengaged the breech block 21 to secure it in a closed position. Closing of the rifle 10 allows the pulley return spring 76 to return the pulley system 68 to its normal state and yet leave the pistons 46, 48 of the piston pumps 38, 40 in their latched, charged state.

Figure 6:
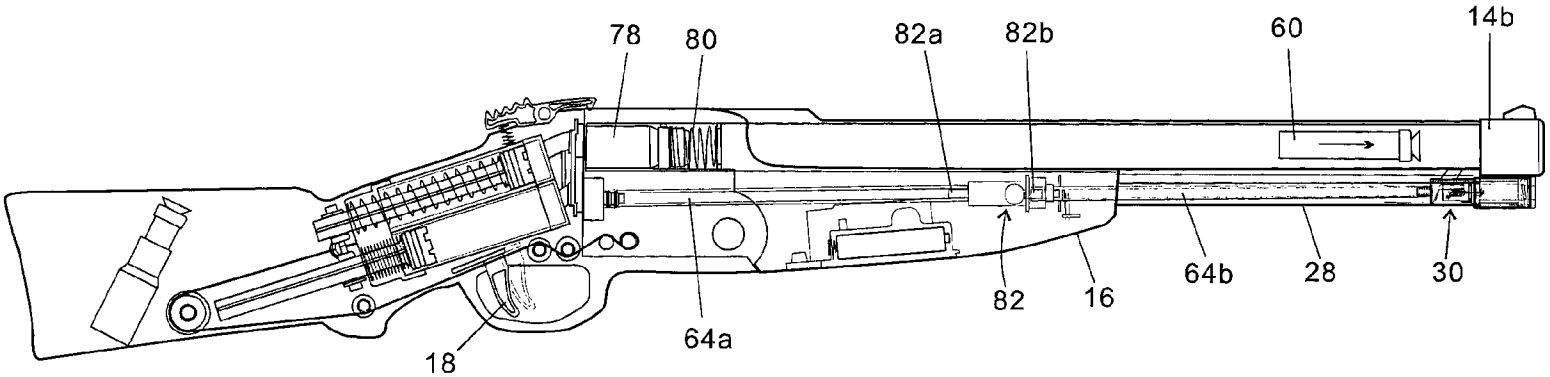
FIG. 6 is a side view of the toy gun of FIG. 1 in a just fired condition.

FIG. 6 shows the toy rifle 10 in a state where a user has pulled or depressed the trigger 18 thereby unlatching the pistons 46, 48 which, under the urging force of their respective compression springs 50, 52 begin to discharge stored air from their cylinders 42, 44. In FIG. 6 it can be seen that the first piston pump discharges its stored air rapidly thereby causing the dart 60 to depart its cartridge and travel along the barrel 14 at speed. The next time the gun 10 is opened the cartridge receiving means will eject the empty cartridge 78 from the breech end 14*a* of the barrel 14. FIG. 6 shows a point in time where the dart 60 has not yet exited the barrel tip 14*b*. The second piston pump 40 has only just started discharging air and does so considerably slower than the first piston pump 38 for reasons as will now be explained.

The second piston pump 40 may be provided with a much weaker compression spring 52 than the spring 50 of the first piston pump 38 thereby reducing the speed of air discharged from the second piston pump 40. However, the flow of air along the passageway 64 connecting the outlet 56 of the second piston pump 40 to the inlet 30*b* of the smoke generator 30 is restricted by a gas flow restriction device 82 that functions as a pressure switch actuator for the heating element of the smoke generator 30. The gas flow restriction device 82 is located at a position in the air passageway 64 generally intermediate the outlet 56 of the second piston pump 40 and the inlet 30*b* of the smoke generator 30, although it could be placed anywhere in the air passageway 64 between the piston pump outlet 56 and the smoke generator inlet 30*b*. Preferably, the gas flow restriction device 82 is housed in the second handle grip 16 of the rifle 10. It can be seen that the air passageway 64 comprises a first conduit 64*a* extending from the breech block 21 to an inlet 82*a* of the gas flow restriction device 82 and a second conduit 64*b* connecting the restriction device's outlet 82*b* to the inlet 30*b* of the smoke generator 30.

As seen in FIG. 7*a* which shows the rifle 10 in a state where the dart 60 has been discharged from the barrel 14, the second piston pump 40 has partially discharged its stored air. Air discharged under pressure from the second pump 40 is conveyed by the first conduit 64*a* to the restriction device 82 where the flow rate of air through the device 82 is throttled. This creates a back pressure within the restriction device 82 which serves a number of purposes. A first effect of the throttled air flow is that it prevents the second pump 40 discharging its stored air as quickly as the first pump 38 discharges its stored air. The use of a weaker compression spring 52 in the second pump also reduces the speed of air discharge from the pump 40. A second effect is to prevent air being conveyed into the smoke chamber of the smoke generator 30 at such a speed that the charge of air is so great that any smoke caught up by the air is not visible when said air exits the tip portion 14*b* of the barrel 14. By slowing the flow rate of air into the smoke chamber, this allows air exiting the smoke generator 30 to become laden with smoke such that said smoke is visible as it drifts out of the barrel tip 14*b*. A third purpose of restricting air flow is to delay the discharge of smoke from the barrel tip 14*b* until after the dart 60 has been discharged from the barrel 14. A fourth purpose of the gas flow rate restriction is to employ the back pressure created in the restriction device 82 to actuate a pressure switch 84 for supplying electrical power to the heating element of the smoke generator 30.

FIG. 7*b* comprises an enlarged view of the gas flow restriction device 82 where a plunger member 86 of the device 82 is in engagement with the pressure switch 84 to actuate it. The slow discharge of air from the second pump 40 results in a time period during which the plunger 86 of the restriction device 82 remains engaged with the pressure switch 84 actuating it. The gas flow restriction device 82 is preferably arranged to provide a one second switch actuation time period, but other periods may be selected for other types of smoke emitting toys.

FIG. 8*a* shows the toy rifle in a state where it has been fired, the dart has been discharged from the barrel, the second pump has discharged its store of air and the final wafts of smoke are being emitted from the barrel tip. As such, FIG. 8*a* shows a state of the rifle similar to that of FIG. 2*a* save for the fact that the trigger has not yet been returned to its firing position.

FIG. 8*b* comprises an enlarged view of the gas flow restriction device 82 where a plunger member 86 of the device 82 is no longer in engagement with the pressure switch 84 to actuate it and thus the smoke generator heating element is switched off.

Figure 9A:
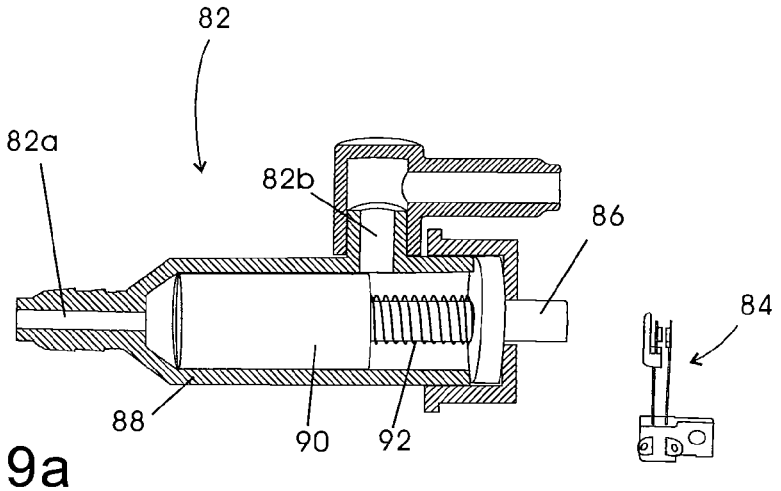
FIG. 9*a* is a sectional side view of a first embodiment of the pressure switch system in a not yet actuated condition.
Figure 9B:
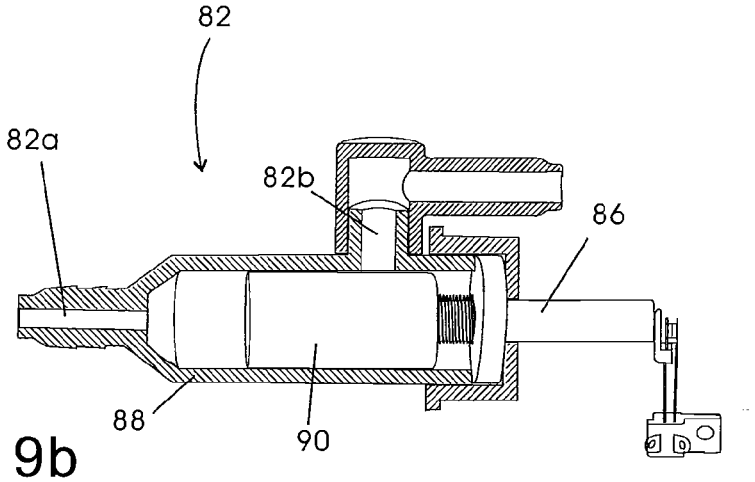
FIG. 9*b* is a sectional side view of the first embodiment of the pressure switch system in an actuated condition.
Figure 9C:
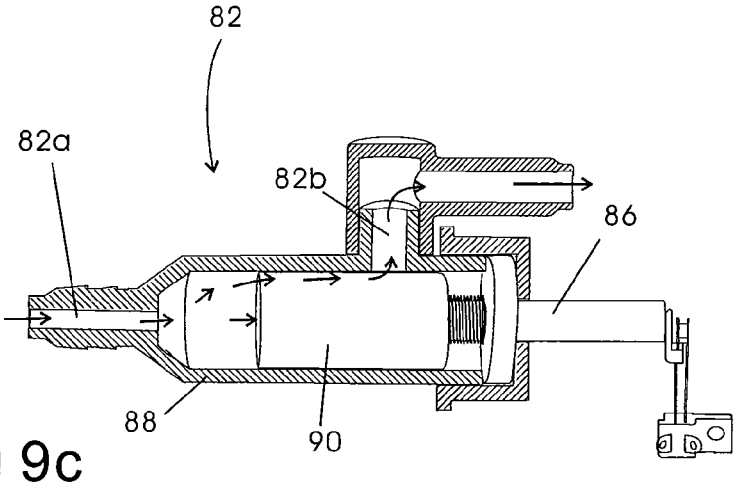
FIG. 9*c* is a sectional side view of the first embodiment of the pressure switch system in an actuated condition with arrowed lines showing the gas/air passageway through the gas flow restriction device.

FIG. 9*a* is a sectional side view of a first embodiment of the gas flow restriction device/pressure switch system 82 in a not yet actuated condition, whereas FIG. 9*b* is a sectional side view of the first embodiment of the pressure switch system 82 in an actuated condition. FIG. 9*c* is a sectional side view of the first embodiment of the pressure switch system 82 in an actuated condition with arrowed lines showing the gas/air passageway through the gas flow restriction device 82. The restriction device 82 comprises a housing 88 having providing the inlet 82*a* and the outlet 82*b*. The housing 88 defines a gas flow passageway between said inlet 82*a* and said outlet 82*b*. A moveable member 90 is arranged in the gas flow passageway such that pressure of gas entering the inlet exerted on said moveable member 90 causes said member 90 to move from a first position to a second position against the action of a biasing means 92 which normally holds the moveable member 90 in its first position. The moveable member 90 is adapted to slow the flow rate of gas through the gas flow passageway by forcing gas to pass through a leakage path defined by at least one surface of the moveable member 90. The moveable member 90 provides the plunger member 86 which extends through a wall of the housing 88. The plunger 86 is adapted to engage the switch 84 to actuate it when said moveable member 90 is moved to its second position.

In the first embodiment, the housing 88 comprises a cylinder and the moveable member 90 comprises a piston. The piston 90 is dimensioned to have a sliding fit within the cylinder but such that air under pressure entering the inlet 82*a* of the housing 88 can leak over the external surface of the piston to reach the outlet 82*b*, preferably at a known rate. The external surface of the piston and the internal surface of the housing 88 between them define a leakage path part of the gas flow passageway. The large diameter of the piston provides a large surface for restricting air flow through the device 82.

Figure 10A:
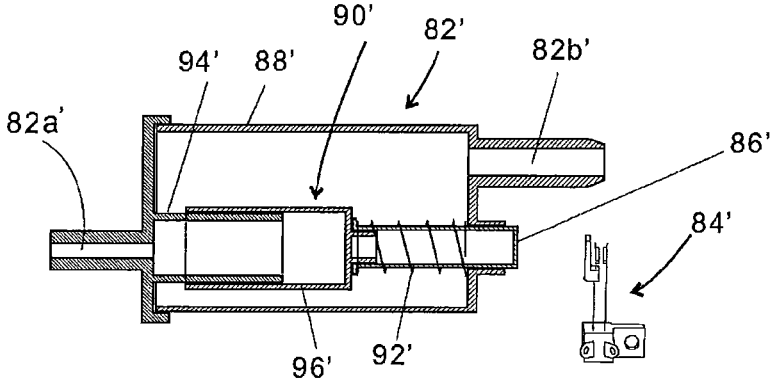
FIG. 10*a* is a sectional side view of a second embodiment of the pressure switch system in a not yet actuated condition.
Figure 10B:
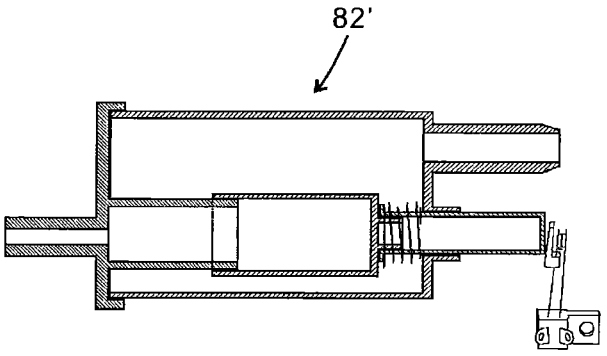
FIG. 10*b* is a sectional side view of the second embodiment of the pressure switch system in an actuated condition.
Figure 10C:
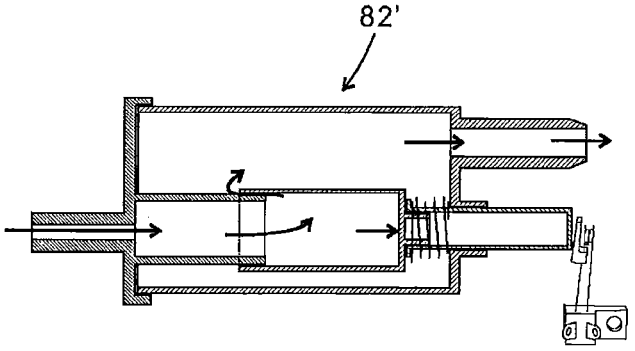
FIG. 10*c* is a sectional side view of the second embodiment of the pressure switch system in an actuated condition with arrowed lines showing the gas/air passageway through the gas flow restriction device.

FIG. 10*a* is a sectional side view of a second embodiment of the pressure switch system 82' in a not yet actuated condition whilst FIG. 10*b* shows the second embodiment of the pressure switch system 82' in an actuated condition. FIG. 10*c* shows the second embodiment of the pressure switch system 82' in an actuated condition with arrowed lines showing the gas/air passageway through the gas flow restriction device. The pressure switch/gas flow rate restriction system 82' of the second embodiment functions in a same manner to the first embodiment, but differs in that the housing 88' contains an open-ended cylinder 94' affixed around the inlet 82*a*'. The moveable member 90' comprises a cylinder 96' open at one end and moveably mounted on the fixed cylinder 94' such that air under pressure entering the inlet 82*a*' of the housing 88' can leak over a part of the internal surface of the moveable cylinder 96' which overlaps a part of the external surface of the fixed cylinder 94'. The part of the internal surface of the moveable cylinder 96' and the part of the external surface of the fixed cylinder 94' between them define the leakage path part of the gas flow passageway through the gas flow restriction device 82'.

Figure 11:
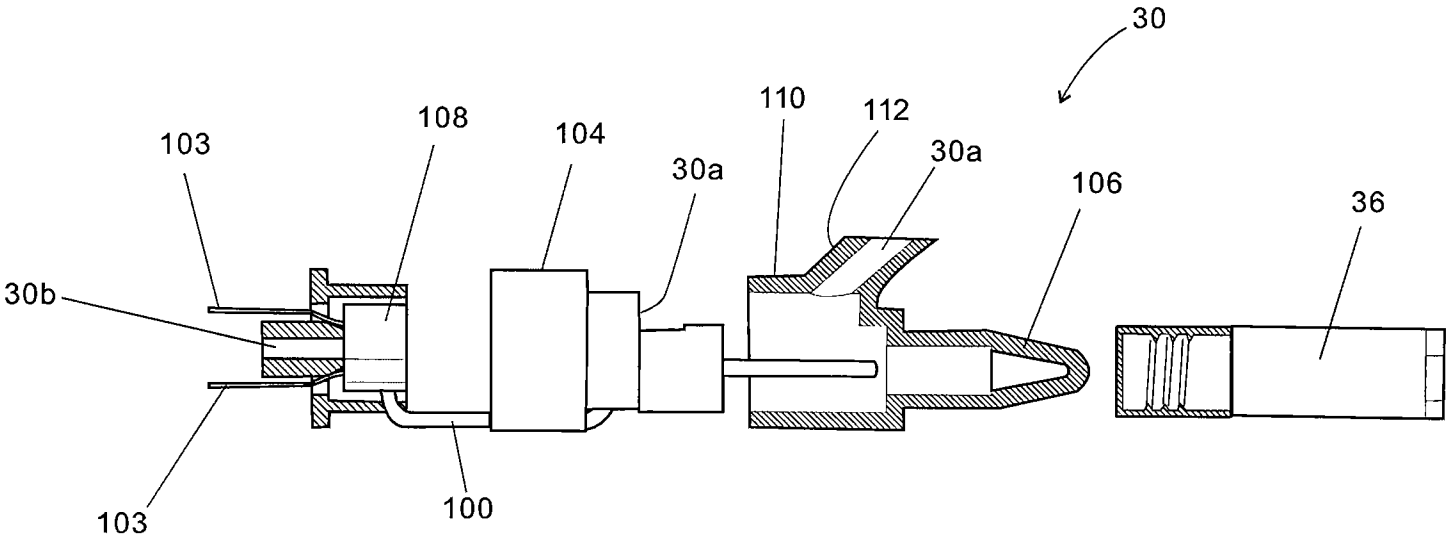
FIG. 11 is an exploded side view of the smoke generator and smoke oil container.

FIG. 11 is an exploded side view of the smoke generator 30 and smoke oil container 36. The smoke generator 30 has a wick 100 with the heating element 102 arranged close to a portion of the wick within the smoke generator housing such that when the heating element 102 is actuated, i.e. receives electrical power at its terminals 103, and becomes sufficiently hot it causes oil in the wick 100 to smoke. The housing is adapted to receive a smoke oil container 36 and another portion of the wick 100 is positioned relative to the housing to enter the container 36 to draw smoke oil therefrom by a wicking action. The housing has member 106 for piercing a seal of the smoke oil container 36 as said smoke oil container 36 is being received at the housing. The portion of the wick 100 positioned to enter the smoke oil container 36 when it is being received at the housing is enclosed by the piercing member 106. The heating element 102 is surrounded by a ceramic housing 108, the ceramic housing 108 being contained within the smoke generator housing. The smoke generator housing comprises a first main housing part 104 and a smoke delivery tube part 110. The main housing part 104 is adapted to fit within the smoke delivery tube part 110. The smoke delivery tube part 110 has a smoke delivery pipe 112 extending outwardly therefrom such that, when the main housing part 104 is received in the smoke delivery tube part 110, the outlet 30*a* of the main housing part 104 is in gaseous communication with the smoke delivery pipe 112 to convey air laden with smoke away from the smoke generator 30. The smoke delivery pipe 112 extends as far as the tip portion 14*b* of the gun barrel 14.

Figure 12B:
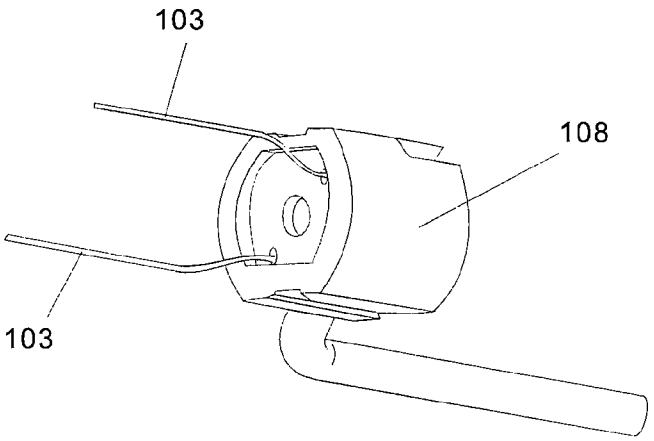
FIG. 12*b* is another view of the heating element, ceramic housing and wick of the smoke generator.
Figure 12A:
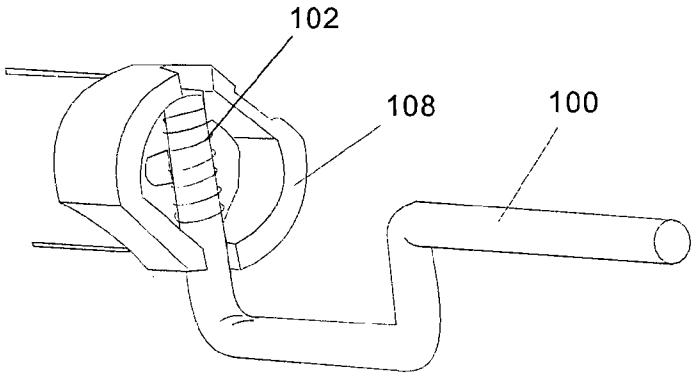
FIG. 12*a* is a view of the heating element, ceramic housing and wick of the smoke generator.

FIG. 12*a* is a view from one side of the heating element 102, ceramic housing 108 and wick 100 of the smoke generator 30 and shows that the heating element 102 may comprise a wire coil wound around a portion of the wick 100. FIG. 12*b* is a view from another side of the heating element 102, ceramic housing 108 and wick 100 of the smoke generator 30.

Referring to FIGS. 13*a* to 13*h*, shown is another embodiment of a toy gun in accordance with the invention. This embodiment comprises a bolt action rifle operating on generally the same principle as that of the first embodiment of FIGS. 1 to 12, namely being arranged to emit smoke once the discharging mechanism has been actuated to discharge a projectile from the muzzle of the rifle. In the following description of this embodiment, like numerals preceded by the numerals "11" will be used to denote like or similar parts to those of the embodiment of FIGS. 1 to 12.

The rifle 1110 has a bolt action mechanism 1101 rather than a breech opening mechanism to enable a cartridge 1178 containing a projectile 1160 to be loaded into a chamber part 1103 of the barrel 1114. The provision of a bolt action mechanism 1101 is the main structural difference between the rifle 1110 of this embodiment and the rifle of the embodiment of FIGS. 1 to 12.

Figure 13A:
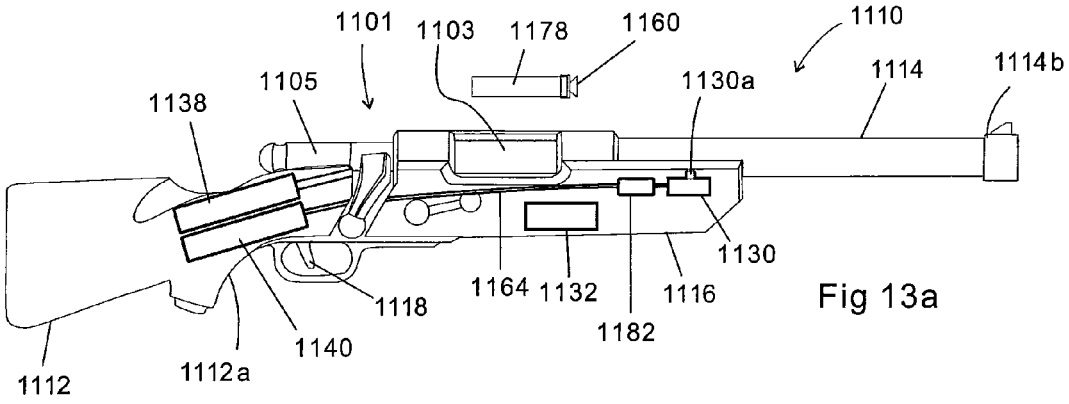
FIG. 13*a* is a side view of a toy gun according to another embodiment of the invention in a closed and not yet loaded state.

As can be seen in FIG. 13*a*, the rifle 1110 accommodates within its second handgrip 1116 a battery compartment 1132, a smoke generator 1130 and a gas flow restriction/pressure switch system 1182. In the first handle grip part 1112*a* of the stock 1112 is accommodated first and second piston pumps 1138, 1140. The first piston pump 1138 is arranged to discharge stored air to the barrel 1114 in response to actuation of the trigger 1118 whilst the second piston pump 1140 is arranged to discharge, also in response to actuation of the trigger 1118, stored air into a passageway 1164 which indirectly connects the output of the second pump 1140 to the inlet of the smoke generator, the gas flow restriction system 1182 being located in said passageway 1164 intermediate the second pump 1140 and the smoke generator 1130. An outlet 1130*a* of the smoke generator is in gaseous communication with a portion of the barrel 1114 to allow smoke generated in the smoke generator 1130 to be communicated to the barrel 1114. However, the outlet 1130*a* of the smoke generator 1130 could be arranged to communicate smoke to the chamber part 1103 of the barrel 114. In any event, the aperture 1130*a* is arranged such that smoke is communicated to a portion of the barrel 1114 in close proximity to the chamber part 1103 such that smoke emits from at least the chamber part 1103 and preferably also from the tip 1114*b* of the barrel 1114.

Charging of the first and second pumps 1138, 1140 is achieved by a similar pulley system means (not shown) as used in the rifle of the first embodiment save for the fact that the cord of such pulley system is extends between the bolt mechanism 1101 and pistons of the first and second pumps 1138, 1140 such that, when a bolt 1105 of the bolt mechanism 1101 is withdrawn, this pulls the cord of the pulley system to withdraw the pistons of the first and second pumps to their charged positions ready for being unlatched when the trigger 1118 is actuated.

It will be appreciated from the foregoing that the operation of the rifle 1110 in emitting smoke is largely similar to that of the rifle of the first embodiment of FIGS. 1 to 12 despite the difference in structures between the two embodiments.

Figure 13B:
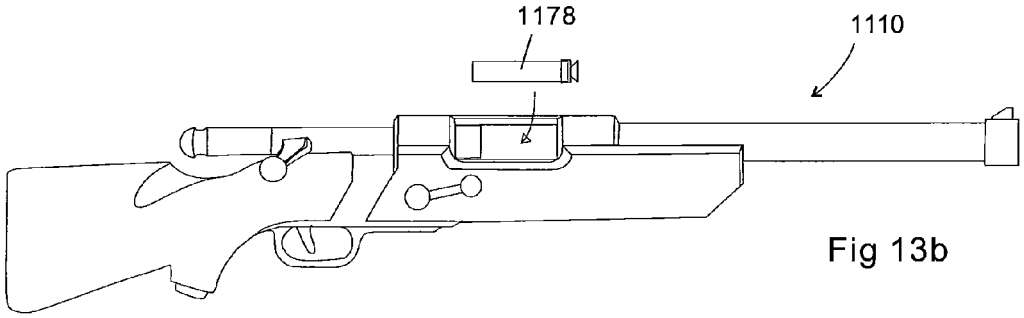
FIG. 13*b* is a side view of the toy gun of FIG. 13*a* in an open, but not yet loaded state.
Figure 13C:
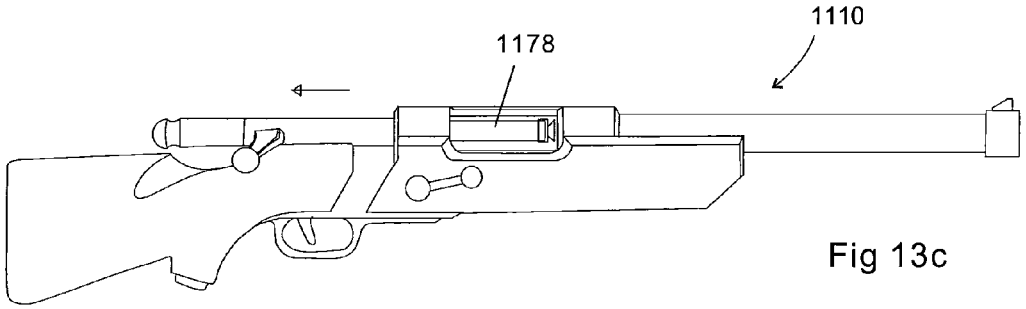
FIG. 13*c* is a side view of the toy gun of FIG. 13*a* in an open and loaded state with the bolt being withdrawn to cock the trigger.
Figure 13D:
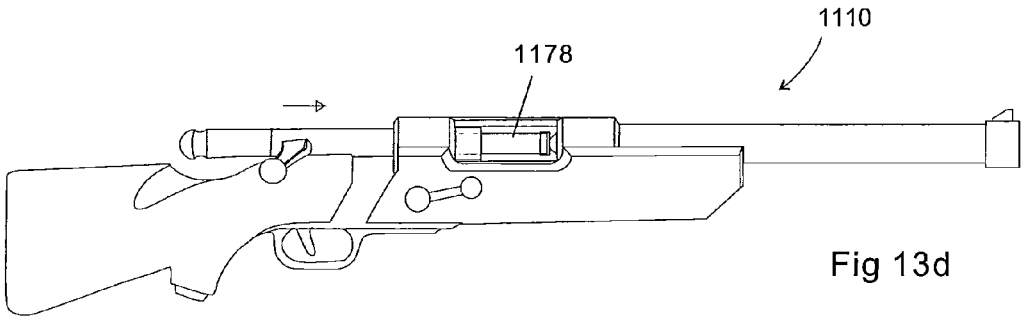
FIG. 13*d* is a side view of the toy gun of FIG. 13*a* in an open and loaded state with the trigger cocked and the bolt being closed.
Figure 13E:
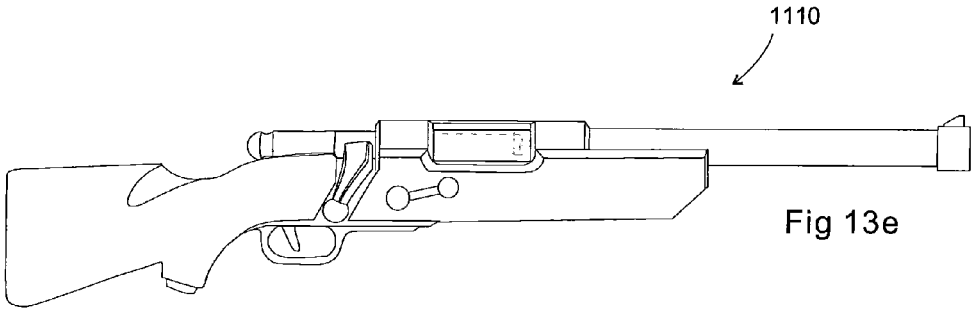
FIG. 13*e* is a side view of the toy gun of FIG. 13*a* in a closed and loaded state ready for firing.
Figure 13F:
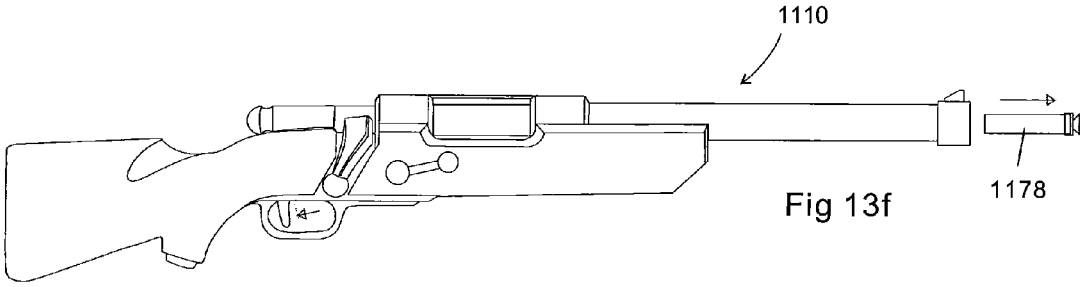
FIG. 13*f* is a side view of the toy gun of FIG. 13*a* in a just fired state.

As can be seen in FIG. 13*a*, the rifle 1110 is in a closed and not yet loaded state in that the bolt 1105 is in its forward-most closed position. In FIG. 13*b*, the bolt 1105 is withdrawn, although not fully, but by a sufficient amount to enable a cartridge 1178 to be loaded into the chamber 1103. In FIG. 13*c*, a cartridge 1178 has been loaded into the chamber 1103 and the bolt 1105 withdrawn to its fullest extent. Drawing the bolt 1105 back to its fullest extent ensures that the first and second pumps 1138, 1140 are charged with a store of air. It may also function to cock the trigger 1118 ready for firing although the trigger may be cocked in other ways. FIG. 13*d* shows the bolt 1105 being returned to its closed position to place the rifle 1110 in a state ready for firing. In FIG. 13*e*, the rifle 1110 is now in a ready for firing state. FIG. 13*f* shows the rifle 1110 when the trigger 1118 has just been actuated whereby the projectile 1160 has just exited the barrel 1114. Actuation of trigger

Figure 13G:
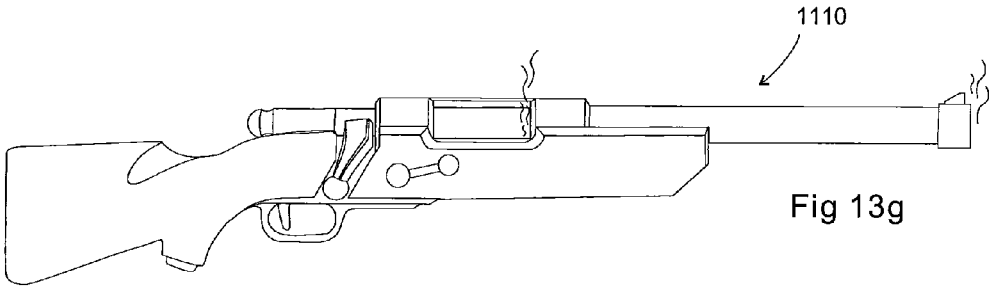
FIG. 13*g* is a side view of the toy gun of FIG. 13*a* in a fired state with smoke emanating from at least the chamber.
Figure 13H:
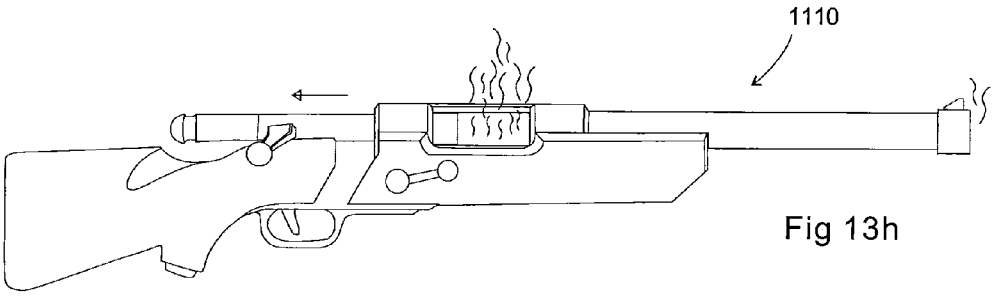
FIG. 13*h* is a side view of the toy gun of FIG. 13*a* in a just unloaded state.

1118 unlatches the pistons of the first and second pumps 1138, 1140 whereby stored air is quickly expelled from the first pump 1138 to cause the projectile 1160 to travel at speed along and out of the barrel 1114 whereas stored air in the second pump 1140 is expelled much more slowly in the same manner and for the same purpose as in the rifle of the first embodiment. As can be seen in FIG. 13*g*, shortly after the projectile 1160 has been discharged from the rifle 1140, smoke generated by the now switched on smoke generator 1130 is communicated to the chamber part 1103 and/or barrel 1114 such that some smoke is seen emanating from the chamber part 1103 of the rifle 1110. Preferably, some smoke also emanates from the tip 1114*b* of the barrel 1114. Finally, as seen in FIG. 13*h*, when the bolt 1105 is withdrawn to unload the rifle 1110, a large quantity of smoke emanates from the open chamber part 1103 with a little smoke being emitted from the barrel tip 1114*b*. As in the first embodiment, the gas restriction system 1182 is arranged to cause the smoke generator to be switched on for a predetermined period of time, preferably one second, after which the smoke generator is switched off as pressure in the gas restriction system 1182 returns to normal.

In general, the invention provides a toy gun which in preferred embodiments is in the form of a breech loading rifle which is capable of firing a projectile such as a dart as well as simultaneously or near simultaneously emitting smoke from the muzzle of a barrel of the gun after the dart has been discharged from the muzzle, but the invention is not exclusively related to breech loading rifles and is applicable to other embodiments of smoke emitting toys and toy guns. For example, the toy gun may comprise a bolt action rifle with smoke being emitted from at or near the bolt action. The toy gun has first and second rechargeable air pumps. A first one of the air pumps automatically discharges stored air into a breech part of the barrel in order to propel a loaded projectile from the gun's barrel. A second one of the air pumps expels stored air through a flow restriction device which doubles up as a pressure switch for actuating a smoke generator located adjacent to the muzzle of the gun. The second air pump also provides a low flow rate of air through the smoke generator to expel smoke from the smoke generator. The second air pump expels stored air much more slowly than the first air pump. The first and second air pumps are simultaneously triggered to release stored air by user actuation of a trigger of the gun. The smoke generator has an outlet in gaseous communication with the muzzle portion of the barrel such that smoke emitted by the generator passes into the muzzle portion of the barrel prior to exhausting from the muzzle.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The invention claimed is:

1. A toy gun, comprising:

a barrel;

a chamber adapted to receive and accommodate a projectile, the chamber is spaced from a muzzle of the barrel;

a mechanism for discharging the projectile from the muzzle, the mechanism comprises:

a first gas storage device comprising a first gas expelling mechanism for discharging stored gas at a first flow rate along a first gas passageway into a rear portion of the barrel to cause the projectile to be discharged from the muzzle; and a second gas storage device comprising a second gas expelling mechanism for discharging stored gas at a second flow rate along a second gas passageway through a smoke generator to cause smoke to be emitted from the smoke generator; the smoke generator is arranged to emit smoke from the chamber and the muzzle when the projectile discharging mechanism has been actuated;

wherein the first gas expelling mechanism is adapted to be acted upon by a first biasing means and the second gas expelling mechanism is adapted to be acted upon by a second biasing means; the first biasing means is adapted to exert a substantially different biasing force than the second biasing means, such that the first flow rate of the discharged gas from the first gas storage device is substantially different to the second flow rate of the discharged gas from the second gas storage device;

a gas flow restriction device connecting the second gas storage device and the smoke generator in the second gas passageway, the gas flow restriction device comprising:

a housing having an inlet and an outlet, said housing defining a gas flow path between said inlet and said outlet; and a movable member arranged in the gas flow path such that pressure of gas entering the housing inlet exerted on said movable member causes said movable member to move from a first position to a second position against the action of a movable member biasing means which normally holds the movable member in the first position; the movable member is adapted to slow a flow rate of gas exiting through the gas flow path and the housing outlet during movement of the movable member by forcing gas to pass through a leakage path defined by at least one surface of the movable member; wherein in the first position, the movable member substantially seals the gas flow path between the housing inlet and the housing outlet, and when in the second position, the movable member unseals the gas flow path between the housing inlet and the housing outlet.

2. The toy gun of claim 1, wherein the first biasing means is adapted to exert a substantially larger biasing force than the second biasing means, such that the first flow rate of the discharged gas from the first gas storage device is faster than the second flow rate of the discharged gas from the second gas storage device, thereby allowing the smoke to be emitted at a slower rate than and thus after the discharge of the projectile.

3. The toy gun of claim 1, wherein the second gas storage device comprises an outlet connected to an inlet of the smoke generator at the second gas passageway.

4. The toy gun of claim 3, wherein the smoke generator comprises a pressure switch adapted to be automatically switched on under an action of a gas flow from the second gas storage device to cause the smoke generator to start generating smoke.

5. The toy gun of claim 1, wherein the first and the second gas expelling mechanisms each comprises a pump and the pump comprises a cylinder housing a piston, the piston being adapted for movement within the cylinder to expel gas from the cylinder through an outlet of the pump, and wherein the pump is rechargeable with gas by drawing the piston away from the pump outlet causing gas to be drawn into the cylinder via a pump inlet.

6. The toy gun of claim 5, wherein the pump is arranged such that, once the piston is withdrawn away from the pump outlet to a pump charged position, a latch holds the piston in its pump charged position against the respective biasing force exerted by the respective biasing means whereupon, in response to a trigger event, the latch releases the piston, which, under the respective biasing force, moves towards the pump outlet thereby expelling gas stored in the cylinder through the pump outlet.

7. The toy gun of claim 1, wherein each of the first and the second gas storage devices is a manually rechargeable gas storage device.

8. The toy gun of claim 1, wherein a same trigger event triggers automatic release of gas from the first and the second gas storage devices and automatically switches on the smoke generator to cause the smoke generator to start generating smoke.

9. The toy gun of claim 1, wherein the gas flow restriction device is arranged to connect an outlet of the second gas storage device with an inlet of the smoke generator at the second gas passageway, whereby the gas flow restriction device controls a flow rate of released gas into the smoke generator.

10. The toy gun of claim 1, wherein the housing of the gas flow restriction device comprises a cylinder, and the movable member comprises a piston, said piston of the movable member being dimensioned to have a sliding fit within the cylinder but such that gas under pressure entering the inlet of the housing can leak over an external surface of the piston to reach the outlet of the housing, the external surface of the piston and an internal surface of the housing between them defining the leakage path of the gas flow path.

11. The toy gun of claim 1, wherein the housing of the gas flow restriction device comprises an open-ended cylinder affixed around the housing inlet and the movable member comprises a cylinder open at one end and movably mounted on the fixed cylinder, such that gas under pressure entering the inlet of the housing can leak over a part of an internal surface of the movable cylinder which overlaps a part of an external surface of the fixed cylinder, the part of the internal surface of the movable cylinder and the part of the external surface of the fixed cylinder between them defining the leakage path of the gas flow path.

* * * * *